US006440898B1

(12) United States Patent
Kranz

(10) Patent No.: US 6,440,898 B1
(45) Date of Patent: Aug. 27, 2002

(54) HEAT-SENSITIVE RECORDING SHEET WITH A SECURITY ELEMENT IN THE FORM OF PRESSURE-SENSITIVE MICROCAPSULES

(75) Inventor: Erich Kranz, Flensburg (DE)

(73) Assignee: Mitsubishi HiTec Paper Flensburg GmbH, Flensburg (DE)

( * ) Notice: Subject to any disclaimer, the term of this patent is extended or adjusted under 35 U.S.C. 154(b) by 0 days.

(21) Appl. No.: 09/530,297

(22) PCT Filed: Aug. 20, 1999

(86) PCT No.: PCT/EP99/06122

§ 371 (c)(1),
(2), (4) Date: Apr. 27, 2000

(87) PCT Pub. No.: WO00/12321

PCT Pub. Date: Mar. 9, 2000

(30) Foreign Application Priority Data

Aug. 27, 1998 (DE) ..... 198 38 893

(51) Int. Cl.[7] ..... B41M 5/30
(52) U.S. Cl. ..... 503/215; 503/204
(58) Field of Search ..... 503/215

(56) References Cited

U.S. PATENT DOCUMENTS 5,395,138 A 3/1995 Chang ..... 283/95
5,401,060 A 3/1995 Chang et al. ..... 283/95

FOREIGN PATENT DOCUMENTS

| | | |
|---|---|---|
| AT | 37 053 | 2/1989 |
| DE | 35 04 730 C2 | 9/1985 |
| DE | 36 01 525 A1 | 7/1986 |
| DE | 37 04 627 A1 | 8/1987 |
| DE | 39 38 978 A1 | 5/1990 |
| DE | 195 01 289 A1 | 7/1996 |
| EP | 623 909 A2 | 11/1994 |

OTHER PUBLICATIONS

Patent Abstracts of Japan, 08 30 0810, Pub. Nov. 19, 1996.

*Primary Examiner*—Bruce H. Hess
(74) *Attorney, Agent, or Firm*—Cohen, Pontani, Lieberman & Pavane

(57) ABSTRACT

A heat-sensitive recording sheet having a substrate with a heat-sensitive recording layer which contains color formers and color acceptors which react with one another under the action of heat. In order to permit the detection of counterfeited documents without the additional use of aids such as UV lamps or chemicals, present in the heat-sensitive recording layer, as a security element, are pressure-sensitive microcapsules which contain one or more color formers in a solvent. The color formers react with the color acceptors, forming a color, after destruction of the microcapsules.

10 Claims, No Drawings

HEAT-SENSITIVE RECORDING SHEET WITH A SECURITY ELEMENT IN THE FORM OF PRESSURE-SENSITIVE MICROCAPSULES

BACKGROUND OF THE INVENTION

1. Field of the Invention

The invention relates to a heat-sensitive recording sheet which has a substrate, a heat-sensitive recording layer which is applied to one side of the substrate and which contains color formers and color acceptors which react with one another under the action of heat in order to produce a text image, and a security element.

2. Discussion of the Prior Art

Heat-sensitive recording sheets have been known for a relatively long time. These materials are predominantly used for recording faxes or facsimiles which have been sent via public telephone networks—the so-called telefax process. A field of use which is increasing in importance for heat-sensitive recording materials has recently been in the use as sales slips, parking tickets from automatic parking machines, entry and travel tickets and receipts in games of chance of all types.

In order to avoid or detect counterfeits, various solutions have already been proposed in the past. In particular, the use has already been proposed of fibers which fluoresce under ultraviolet irradiation and of which a low quantity is mixed with the paper fiber pulps before sheet formation. Corresponding proposals for papers not to be included in the field of heat-sensitive recording materials are found in Austrian reference AT E 37053 B and, according to German reference DE 19501289 A 1, for a heat-sensitive recording paper.

Microcapsules have also already been proposed to be used in the production of heat-sensitive recording sheets. The known proposals predominantly relate to the improvement of the storage stability and the development of recording materials which are simultaneously pressure-sensitive and heat-sensitive and which, in addition, also permit heat-sensitive image transfer.

German reference DE 35 04 730 C 2 discloses a heat-sensitive image transfer recording sheet which, on one side of its substrate, has a heat-sensitive recording layer and, on the other side, has a heat-sensitive and pressure-sensitive image transfer layer. Arranged in the heat-sensitive and pressure-sensitive image transfer layer are microcapsules which contain a colorless color former in a non-volatile solvent, and microcapsules which contain a color acceptor in a non-volatile solvent. Also present in the image transfer layer are a solid, colorless electron-donating color former and a solid, colorless, electron-accepting color developer and a wax. If the heat-sensitive image transfer recording sheet is laid on a sheet of blank paper and if a thermal head is allowed to act on the heat-sensitive recording layer, an image is produced on the heat-sensitive recording layer, and the image of the recording is produced on the blank paper by heat transfer. In addition, an image can be produced on the blank paper sheet by means of pressure on the heat-sensitive image transfer recording sheet.

The idea of setting a certain pressure sensitivity as well in the case of a heat-sensitive and thermally transferable recording sheet is taken up in German reference DE 36 01 525 A 1 in that only selected points in the thermally transferable layer are designed to be pressure sensitive by these points containing color formers and color developers, at least one of these components being contained in micro capsules.

While in the two abovementioned proposals, the object consists in the development of a heat-sensitive paper which is provided with an image transfer layer and, at the same time, is pressure sensitive, German reference DE 37 04 627 A 1 provides, in a heat-sensitive recording material in which the color reaction takes place between a diazo compound and an associated coupling component, for at least one of the two reaction components to be contained in a microcapsule, in order in this way to improve the storage stability of the unwritten material and the sensitivity.

German reference DE 39 38 978 A 1 discloses a two-color recording material in which a heat-sensitive color-forming layer known per se and a light-sensitive, heat-sensitive color-forming layer are applied one after another to a substrate. The second layer contains microcapsules in which a leuco dye and a photo-oxidation agent are contained. A reduction agent is provided in the light-sensitive, heat-sensitive color-forming layer. The production of an image on the light-sensitive, heat-sensitive recording layer is carried out by heating with a heating block and subsequent irradiation with an ultrahigh-pressure mercury vapor lamp.

Japanese reference JP 08 300 810 A discloses a heat-sensitive recording material which, apart from the heat-sensitive coating applied to its front side, provides a layer of color formers and acceptors applied to the front side of its substrate. This is intended to make counterfeiting attempts visible on the front side of the heat-sensitive recording material. At least one of the reaction partners is encapsulated. The layer comprising color formers and acceptors is covered by a polyolefin resin layer (not specifically disclosed), on which a transparent or translucent paper is arranged. The disadvantage with this proposal, apart from the complicated structure of the recording material, is that the image produced by the attempt at counterfeiting does not stand out clearly enough from the image produced on the front side by heat.

SUMMARY AND DESCRIPTION OF THE INVENTION

The object of the present invention is to provide a heat-sensitive recording sheet with a security element which can be used for the production of entry tickets, travel passes, receipts and in games of chance, and which permits the detection of counterfeited documents, which have been produced without the use of the recording sheet according to the invention, without the use of mechanical or electrical aids such as UV lamps or chemicals to be applied to the recording material.

In order to achieve the above object, the invention provides a recording sheet which has a substrate, a heat-sensitive recording layer which is applied to one side of the substrate and which contains color formers and color acceptors which react with one another under the action of heat, in order to produce a text image, and a security element. The recording sheet is defined by the fact that the security element in the heat-sensitive recording layer comprises pressure-sensitive microcapsules which contain one or more color formers in a solvent and react with the color acceptors, forming a color, after the destruction of the microcapsules.

Suitable substrates which are considered are raw paper having a mass per unit area of 45 to 250 g/m$^2$, preferably 70 to 150 g/m$^2$. In particular, wood-free raw papers or those having a low proportion of ground wood are suitable. Before the application of the heat-sensitive recording layer, the substrates can further be provided with a precoat with a mass per unit area of 3 to 12 g/m$^2$. The heat-sensitive recording layer is applied in a suitable manner with a mass per unit area in the range from 3 to 6 g/m$^2$. The mass per unit area of the finished heat-sensitive recording sheet is 48 to 268 g/m$^2$, preferably 73 to 168 g/m$^2$.

The heat-sensitive recording layer contains 5 to 50 parts by weight of microcapsules, based on its (oven-dry) total weight, with a particularly preferred range between 12 and 30 parts by weight.

The microcapsules incorporated into the heat-sensitive recording layer contain 1 to 8 parts by weight, preferably 2.5 to 6.5 parts by weight, of color formers, based on the (oven-dry) total weight of the microcapsules.

The measure of introducing microcapsules into the heat-sensitive recording layer means that, for example in the case of an entry check, there is the possibility of producing an image in the heat-sensitive recording layer through the action of pressure and in this way of checking the authenticity of the paper used. If the microcapsules are destroyed by the action of pressure, for example from a metal stamp, the color formers which are released react with the acceptors of the heat-sensitive recording layer and supply an image corresponding to the impression of the stamp. The color formers should preferably be selected such that there is a color contrast between the image produced by heat in the recording layer and the image produced by the color formers which are released in the recording layer.

EXAMPLE

The following example explains the invention:

A pigmented precoat of 4 g/m$^2$ is applied to a wood-free paper with a mass per unit area of 76 g/m$^2$ and is dried. The dried precoat is covered with a coating color in order to form a heat-sensitive recording layer which, in addition to the color formers and color acceptors needed to produce an image by means of heat, also contains microcapsules with a color former composition dissolved therein in solvent. The application weight is 5 g/m$^2$ oven-dry. The weight ratio of temperature-sensitive components and pressure-sensitive components in the dried recording layer is 3.5:1, which means that 22 parts by weight of microcapsules are contained in the heat-sensitive recording layer. As a result of the action of pressure from a metal stamp, an impression of the stamp is produced on the front side, which documents the authenticity of the paper employed.

The invention is not limited by the embodiments described above which are presented as examples only but can be modified in various ways within the scope of protection defined by the appended patent claims.

What is claimed is:

1. A heat-sensitive recording sheet, comprising:

a substrate;

a heat-sensitive recording layer which is applied to one side of the substrate and which contains color formers and color acceptors which react with one another under the action of heat in order to produce a text image; and a security element, the security element comprising pressure-sensitive microcapsules which are present in the heat-sensitive recording layer and which contain at least one color former in a solvent, said color formers reacting with the color acceptors so as to form a color marking after destruction of the microcapsules.

2. A heat-sensitive recording sheet as defined in claim 1, wherein the heat-sensitive recording layer contains 5 to 50 parts by weight of microcapsules, based on its oven-dry total weight.

3. A heat-sensitive recording sheet as defined in claim 2, wherein the heat-sensitive recording layer contains 12 to 30 parts by weight of microcapsules, based on its oven-dry total weight.

4. A heat-sensitive recording sheet as defined in claim 1, wherein the microcapsules contain 1 to 8 parts by weight of color formers, based on their oven-dry total weight.

5. A heat-sensitive recording sheet as defined in claim 4, wherein the microcapsules contain 2.5 to 6.5 parts by weight of colorformers, based on their oven-dry total weight.

6. A heat-sensitive recording sheet as defined in claim 1, wherein the heat-sensitive recording sheet has a mass per unit area of 48 to 268 g/m$^2$.

7. A heat-sensitive recording sheet as defined in claim 6, wherein the mass per unit area of the heat-sensitive recording sheet is 73 to 168 g/m$^2$.

8. A heat-sensitive recording sheet as defined in claim 1, wherein the substrate is a coating base paper having a mass per unit area of 45 to 250 g/m$^2$.

9. A heat-sensitive recording sheet as defined in claim 8, wherein the mass per unit area of the substrate is 70 to 150 g/m$^2$.

10. A heat-sensitive recording sheet as defined in claim 8, wherein the substrate is a wood-free coating base paper.

* * * * *